US010337124B2

(12) United States Patent
Egan

(10) Patent No.: US 10,337,124 B2
(45) Date of Patent: Jul. 2, 2019

(54) TEXTILE GRAPHENE COMPONENT THERMAL FIBER

(71) Applicant: Teague Egan, Fort Lauderdale, FL (US)

(72) Inventor: Teague Egan, Fort Lauderdale, FL (US)

( * ) Notice: Subject to any disclaimer, the term of this patent is extended or adjusted under 35 U.S.C. 154(b) by 45 days.

(21) Appl. No.: 15/248,918

(22) Filed: Aug. 26, 2016

(65) Prior Publication Data

US 2017/0058433 A1 Mar. 2, 2017

Related U.S. Application Data

(60) Provisional application No. 62/210,226, filed on Aug. 26, 2015.

(51) Int. Cl.
*D01F 1/04* (2006.01)
*D01F 1/10* (2006.01)
(Continued)

(52) U.S. Cl.
CPC ..... *D01F 8/00* (2013.01); *D01F 1/10* (2013.01); *D01F 1/04* (2013.01); *D01F 1/09* (2013.01); *D10B 2101/122* (2013.01); *D10B 2331/04* (2013.01); *D10B 2401/04* (2013.01); *D10B 2501/00* (2013.01); *D10B 2503/06* (2013.01)

(58) Field of Classification Search
CPC ..... D01F 8/00; D01F 1/10; D01F 1/09; D01F 1/04; D10B 2501/00; D10B 2101/122; D10B 2401/04; D10B 2503/06; D10B 2331/04
USPC ..... 428/199–201, 311, 361–365; 442/372, 442/373
See application file for complete search history.

(56) References Cited

U.S. PATENT DOCUMENTS

2004/0043174 A1* 3/2004 Schnurer ..... D01F 1/106 428/36.1
2005/0208300 A1* 9/2005 Magill ..... D01D 5/24 428/364

(Continued)

OTHER PUBLICATIONS

Superior Thermal Conductivity of Single-Layer Graphene, Alexander A. Balandin, Suchismita Ghosh, Wenzhong Bao, Irene Calizo, Desalegne Teweldebrhan, Feng Miao, and Chun Ning Lau, Nano Letters 2008 8 (3), 902-907, DOI: 10.1021/nl0731872 (Year: 2008).*

*Primary Examiner* — Jennifer A Chriss
*Assistant Examiner* — Rebecca Janssen

(57) ABSTRACT

A textile graphene component thermal fiber, or filament yarn, is able to be integrated into a textile, for example performance knits, woven and non-woven garments and linens, in order to conduct absorb or emit heat in order to regulate the body temperature for a user. The textile graphene component thermal fiber is able to absorb thermal energy and optimally conduct the thermal energy for extended periods of time. The textile graphene component thermal fiber includes a quantity of polymers, a first quantity of graphene, and a second quantity of graphene The quantity of polymers and the first quantity of graphene are mixed into a polymeric sheath. The second quantity of graphene and the quantity of thermally conductive substances are mixed into a thermal-conducting core. The polymeric sheath encloses the thermal conducting core in order to form the textile bi-component thermal fiber.

7 Claims, 4 Drawing Sheets

(51) Int. Cl.
*D01F 8/00* (2006.01)
*D01F 1/09* (2006.01)

(56) References Cited

U.S. PATENT DOCUMENTS

2013/0011652 A1* 1/2013 Abraham ..... D21F 1/0027
428/221
2015/0232664 A1* 8/2015 Guo ..... C08L 77/02
252/75
2016/0081281 A1* 3/2016 Horinek ..... A01G 22/00
47/1.01 R
2017/0226341 A1* 8/2017 Maurer ..... C08L 77/06

* cited by examiner

TEXTILE GRAPHENE COMPONENT THERMAL FIBER

The current application claims a priority to the U.S. Provisional Patent application Ser. No. 62/210,226 filed on Aug. 26, 2015.

FIELD OF THE INVENTION

The present invention relates generally to textiles. More specifically, the present invention relates to homo-filament, mono-filament, bi-component, or multi-component fibers for textile applications. The fiber provides thermal conduction and heat transfer properties to the textile.

BACKGROUND OF THE INVENTION

There is a need for a thermally reactive textile that can undeniably take thermal energy in the form of infrared energy or other forms of energy whether it be from the human body, the sun, black-body radiation, and optimally conduct that heat for extended time periods. By conducting absorbed heat, the fiber will have accelerated evaporation qualities and enhance thermal manipulation for thermal regulation in mammals. This thermal regulation can be used to increase bio-activity, and human performance and recovery.

Thermally conductive bi-component textiles have been proven to decrease the drying time of washed materials containing thermally conductive minerals due to their thermal properties. These thermal properties range from increased thermal conductivity, sun protection, far infrared emissivity, and an increase in the rate of water evaporation as a result of being stimulated by an infrared source.

Graphene is being utilized in industries such as technology, military defense, computers, and is continuously growing. Continuous links of graphene have been proven to increase thermal conductance in current research. The measured thermal conductivity of graphene is in the range of 3000-5000 W/mK at room temperature which is the highest thermally conductive material discovered to date, which is approximately thirteen times more thermally conductive than copper. Thermal conductivity depends on the width of the flake of graphene. Graphene is known for its flexibility, durability, thermal responsiveness, and thermal conductance. Graphene however has not yet been utilized in combination with thermally conductive textiles that contain thermally conductive minerals or any other mono-component or bi-component, or multi-component fiber in textiles (other than maybe testing in Kevlar.)

The present invention is a textile graphene component thermal fiber. The present invention utilizes graphene in order to impart favorable heat and current transfer properties into synthetic fibers. The synthetic fibers are then able to be woven into garments, linens, or other textile goods, such that the garments, linens, or other textile goods conduct heat for appropriate thermal regulating applications of each.

DETAIL DESCRIPTIONS OF THE INVENTION

All illustrations of the drawings are for the purpose of describing selected versions of the present invention and are not intended to limit the scope of the present invention.

The present invention is a textile graphene component thermal fiber, which is able to be integrated into a textile, for example woven and non-woven garments and linens.

The present invention conducts and helps to absorb or emit heat in order to regulate the body temperature for a user. This thermal regulation can be used to increase bio-activity, and human performance and recovery. When implemented, the present invention is able to absorb thermal energy from the human body, the sun, black body radiation and other heat emissions and optimally conduct the thermal energy for extended periods of time. A garment made from the present invention, for example, is able to keep a person cool in the summer heat by conducting heat from the person's body, or keep a person warm in cold winter by absorbing the thermal energy from the sun to conduct the heat to the person. In addition, the present invention allows the textile to dry more quickly, by allowing the greater heat transfer to water molecules absorbed by the textile more effectively.

Figure 1:
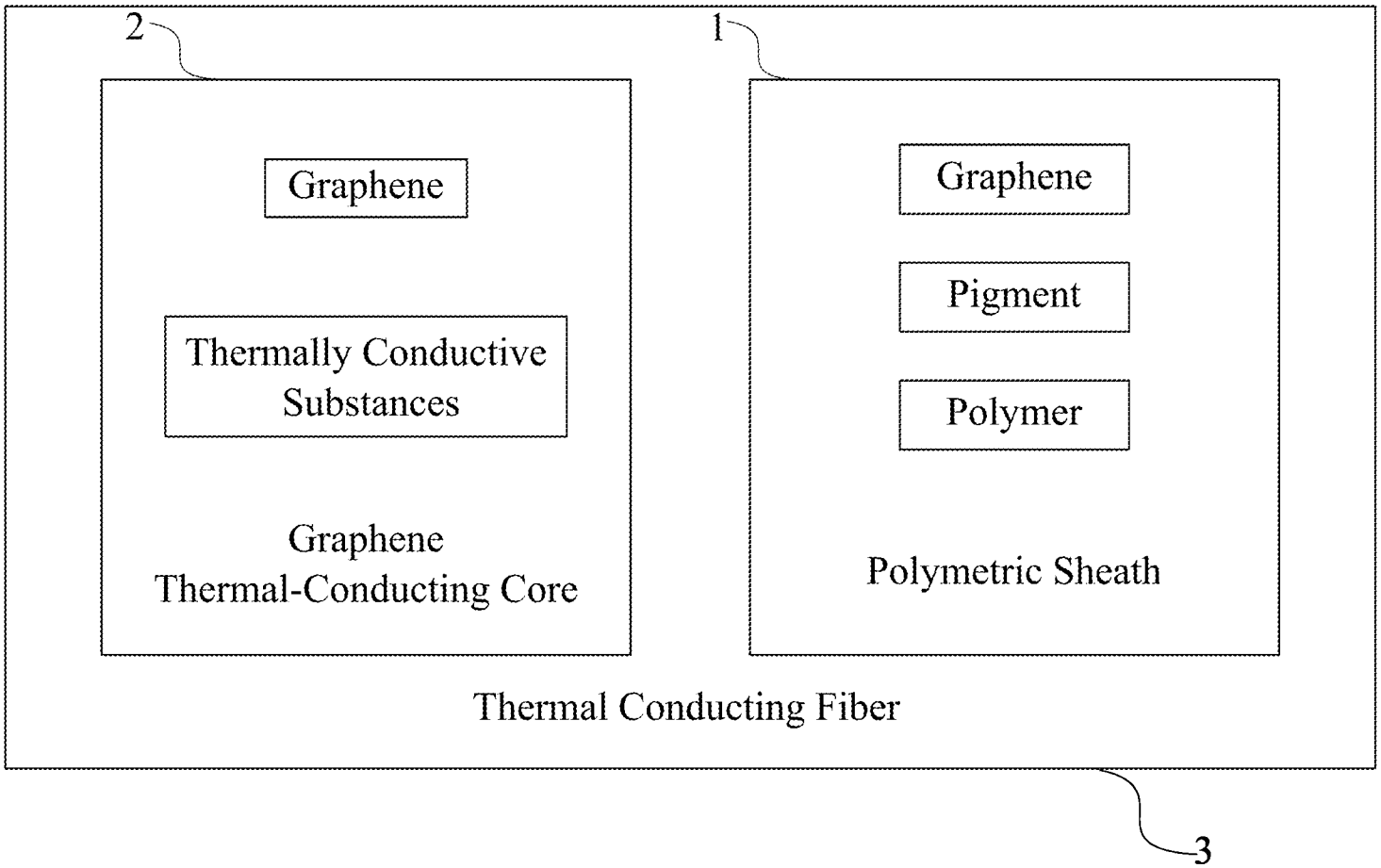
FIG. 1 is a block diagram illustrating the materials of the present invention, wherein the present invention includes a quantity of thermally conductive substances.
Figure 2:
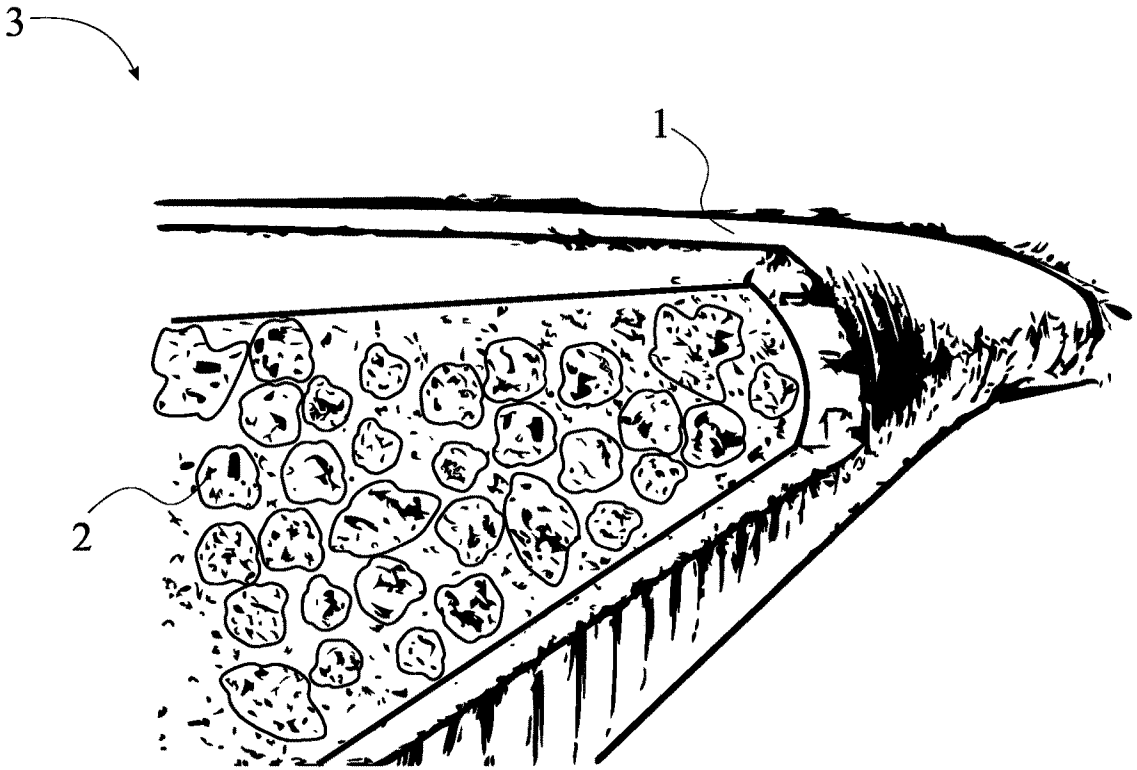
FIG. 2 is a perspective view of the present invention, wherein a portion of the polymeric sheath is cut away to expose the thermal-conducting core.
Figure 3:
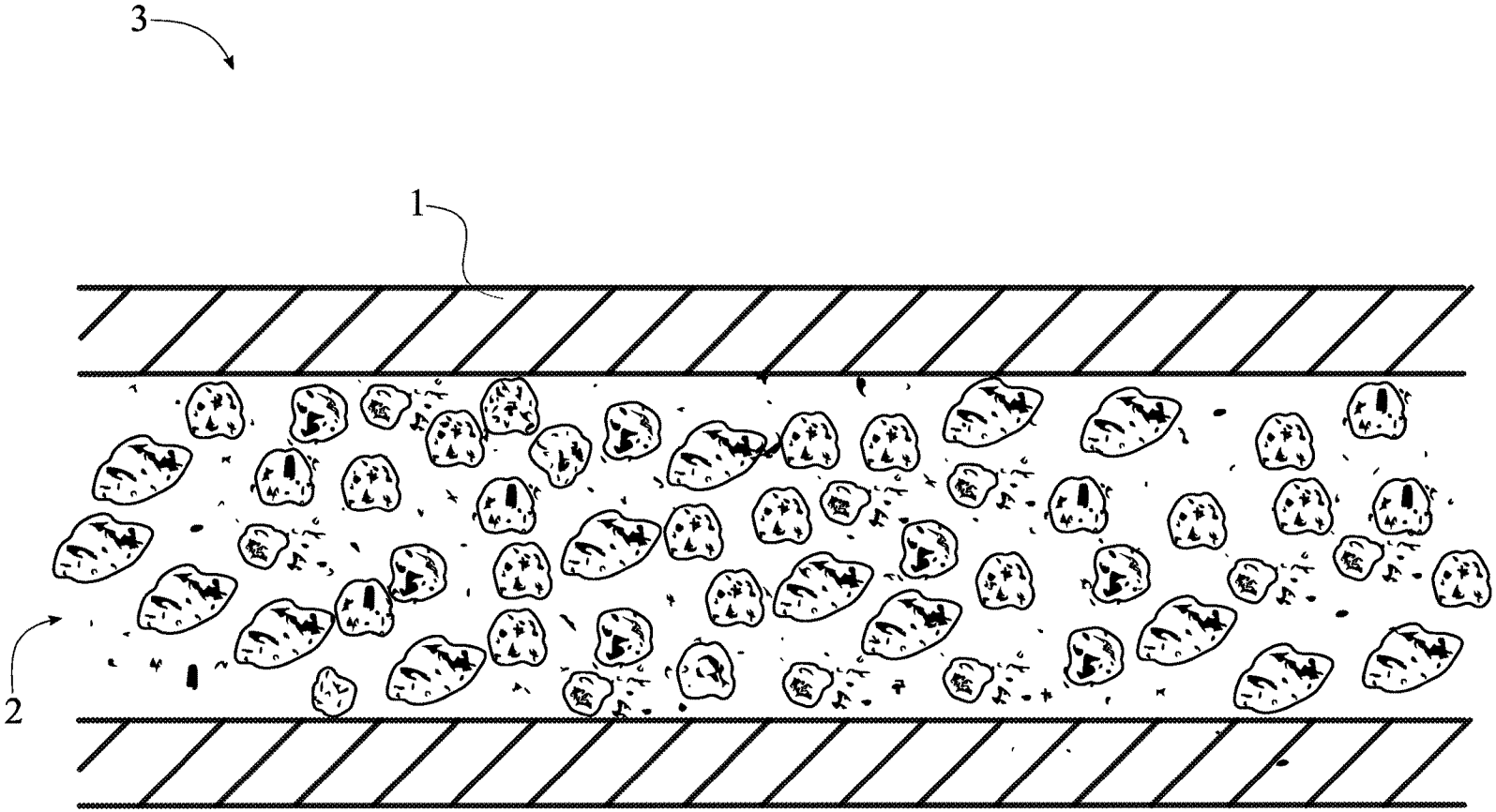
FIG. 3 is a sagittal, cross-sectional view of the present invention.
Figure 4:
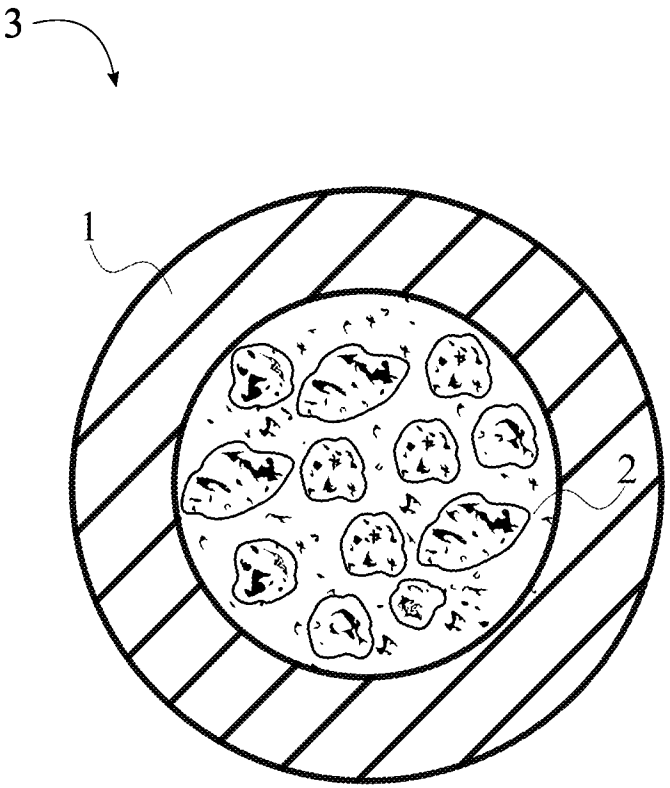
FIG. 4 is a lateral, cross-sectional view of the present invention.

In accordance to FIG. 1, the present invention comprises a quantity of polymer, a first quantity of graphene, and a second quantity of graphene. The quantity of polymer and the first quantity of graphene is homogeneously mixed into a polymeric sheath 1. The second quantity of graphene is a thermal-conducting core 2. The polymeric sheath 1 protects and provides a flexible tubular structural support around the thermal-conducting core 2. The thermal-conducting core 2 allows for heat transfer between the environment and the present invention, effectively. As detailed in FIG. 2 to FIG. 4, the polymeric sheath 1 encases the thermal-conducting core 2 into a thermal conducting fiber 3. The polymeric sheath 1 is able to enclose the thermal-conducting core 2 by extruding the polymeric sheath 1 and the thermal-conducting core 2 through a spinneret or passing the thermal-conducting core 2 through a solution of the polymeric sheath 1. The thermal conducting fiber 3 is able to be integrated into woven and non-woven garments, linens and other textiles to impart favorable heat transfer properties to the textile.

In accordance to the preferred embodiment of the present invention, the thermal-conducting core 2 is at most 5% by weight (wt %) of the thermal conducting fiber 3, such that thermal conducting fiber 3 is able to maintain structural stability. More specifically, the thermal-conducting core 2 is preferred to be between 0.25 wt % and 1.25 wt % of the thermal conducting fiber 3 such that the thermal-conducting core 2 is present in sufficient quantity in order to conduct thermal energy effectively, as shown in Table 1. The thermal-conducting core 2 is preferred to have a thermal conductivity ranging from 1000 to 5000 watts per meter Kelvin.

TABLE 1

| Thermal Conducting Fiber | |
|---|---|
| Component | Approximate percent by weight (wt %) |
| Thermal-conducting Core | 0.25%-1.25% |
| Polymeric Sheath | 98.75%-99.75% |

Further in accordance to the preferred embodiment of the present invention, the quantity of polymer is between 90 wt % and 99 wt % of the polymeric sheath 1, as detailed in Table 2. The first quantity of graphene is between 0.1 wt % and 10 wt % of the polymeric sheath 1. This composition for the polymeric sheath 1 allows for the quantity of graphene to conduct thermal energy between an external source to the thermal-conducting core 2.

TABLE 2

| Polymeric Sheath | |
|---|---|
| Component | Approximate percent by weight (wt %) |
| Polymer | 90%-99% |

In some embodiments of the present invention, the present invention comprises a quantity of pigment, as shown in Table 2. The quantity of pigment provides color to the polymeric sheath 1 such that the present invention is able to be produced in a variety of colors. The quantity of pigment is homogeneously mixed into the polymeric sheath 1 in order to produce a uniform color throughout the polymeric sheath 1. The quantity of pigment is preferred to be approximately 0.5 wt % of the polymeric sheath 1 in order to impart the hue of the pigment to the polymeric sheath 1.

The quantity of polymer is preferred to be selected from a group consisting of: polyester, spandex, nylon, cotton, polyethylene terephthalate (PET), polytrimethylene terephthalate (PTT), rayon, acrylonitrile butadiene styrene, acrylic, celluloid, cellulose acetate, cyclo olefin copolymer, ethylene-vinyl acetate, ethylene-vinyl alcohol, fluoroplastics, ionomers, thermoplastic acrylic-polyvinyl chlorides, liquid crystal polymer, polyacetal, polyacrylates, polyacrylonitrile, polyamide, polyamide-imide, polyaryletherketone, polybutadiene, polybutylene, polybutylene terephthalate, polycaprolactone, polychlorotrifluoroethylene, polycyclohexylene dimethylene terephthalate, polycarbonate, polyhydroxyalkanoates, polyketone, polyester, polyethylene, polyetheretherketone, polyetherimide, polyethersulfone, polyethylenechlorinates, polyimide, polylactic acid, polymethylpentene, polyphenylene oxide, polyphenylene sulfide, polyphthalamide, polystyrene, polysulfone, polyurethane, polyvinyl acetate, polyvinyl chloride, polyvinylidene chloride, styrene-acrylnitrile, and combinations thereof. This group allows the polymeric sheath 1 to be flexible and lightweight, while being able to be extruded about the thermal-conducting core 2 during production in order to protect the thermal-conducting core 2.

Some polymers are selected for the optical properties of the polymer. For some implementations of the present invention, the present invention is preferred to absorb, enhance, reflect, refract, or modify the wavelength of incident light. In particular, PET polymers are effective in polarizing the incident light.

In some embodiments of the present invention, the present invention comprises a quantity of thermally conductive substances. The quantity of thermally conductive substances allow the present invention to have different heat transfer profiles than using graphene alone. The quantity of thermally conductive substances is heterogeneously mixed with the second quantity of graphene into the thermal-conducting core 2. The quantity of thermally conductive substances is preferred to be between 1.0 wt % and 1.5 wt % of the thermal-conducting core 2. The second quantity of graphene is preferred to be between 0.1 wt % and 40 wt % of the thermal-conducting core 2. The second quantity of graphene and the quantity of thermally conductive substances are preferred mixed at a ratio of 5:1. This composition for the thermal-conducting core 2 allows the thermal-conducting core 2 to transfer heat to and from the thermal-conducting core 2 efficiently.

In accordance to a specific embodiment of the present invention, the quantity of thermally conductive substances is selected from a group consisting of: silver, copper, zinc, nickel, iron, platinum, carbon, gold, titanium, and combinations thereof. Each of these thermally conductive substances is selected due having high thermal conductivity properties, therefore, allowing the present invention to conduct heat to or emit heat from the graphene thermal-conducing core 2. In a specific embodiment for the quantity of thermally conductive substances, the quantity of thermally conductive substances is a combination of a quantity of silver, a quantity of aluminum, and a quantity of titanium. The quantity of silver is approximately 30 wt % of the thermally conductive substances. The quantity of aluminum is approximately 20 wt % of the thermally conductive substances. The quantity of titanium is approximately 10 wt % of the thermally conductive substances. This composition provides the quantity of silver, the quantity of aluminum, and the quantity of titanium in sufficient amounts to effectively transfer heat between the present invention and the surroundings.

Although the invention has been explained in relation to its preferred embodiment, it is to be understood that many other possible modifications and variations can be made without departing from the spirit and scope of the invention as hereinafter claimed.

What is claimed is:

1. A textile graphene component thermal fiber comprising:

a thermal conducting fiber;

the thermal conducting fiber comprising a quantity of pigment, a quantity of polymer, a first quantity of graphene, a second quantity of graphene and a quantity of thermally conductive substances;

the quantity of pigment, the quantity of polymer and the first quantity of graphene being homogeneously mixed into a polymeric sheath;

the quantity of thermally conductive substances and the second quantity of graphene being homogeneously mixed into a thermal-conducting core;

the polymeric sheath encasing the thermal-conducting core;

the thermal-conducting core having a thermal conductivity ranging from 1000to 5000 watts per meter Kelvin (W/mK);

the thermal-conducting core being between 0.25 wt % and 1.25 wt % of the thermal conducting fiber;

the quantity of thermally conductive substances being a combination of a quantity of silver, a quantity of aluminum, and a quantity of titanium;

the quantity of silver being approximately 30 wt % of the thermally conductive substances;

the quantity of aluminum being approximately 20 wt % of the thermally conductive substances; and the quantity of titanium being approximately 10 wt % of the thermally conductive substances.

2. The textile graphene component thermal fiber, as claimed in claim 1, further comprising:

the quantity of polymer being between 90 wt % and 99 wt % of the polymeric sheath; and the first quantity of graphene being between 0.1 wt % and 10 wt % of the polymeric sheath.

3. The textile graphene component thermal fiber, as claimed in claim 1, further comprising:

the quantity of polymer being selected from a group consisting of: polyester, spandex, nylon, cotton, polyethylene terephthalate (PET), polytrimethylene terephthalate (PTT), rayon, acrylonitrile butadiene styrene, acrylic, celluloid, cellulose acetate, cyclo olefin copolymer, ethylene-vinyl acetate, ethylene-vinyl alcohol, fluoroplastics, ionomers, thermoplastic acrylic-polyvinyl chlorides, liquid crystal polymer, polyacetal, polyacrylates, polyacrylonitrile, polyamide, polyamideimide polyaryletherketone, polybutadiene, polybutylene, polybutylene terephthalate, polycaprolactone, polychlorotrifluoroethylene, polycyclohexylene dimethylene terephthalate, polycarbonate, polyhydroxyalkanoates, polyketone, polyethylene, polyetheretherketone, polyetherimide, polyethersulfone, polyethylenechlorinates, polyimide, polylactic acid, polymethylpentene, polyphenylene oxide, polyphenylene sulfide, polyphthalamide, polystyrene, polysulfone, polyurethane, polyvinyl acetate, polyvinyl chloride, polyvinylidene chloride, styrene-acrylnitrile, and combinations thereof.

4. The textile graphene component thermal fiber, as claimed in claim 1, further comprising:

the quantity of thermally conductive substances being between 1.0 wt % and 1.5 wt % of the thermal-conducting core.

5. The textile graphene component thermal fiber, as claimed in claim 1, further comprising:

the second quantity of graphene being between 0.1 wt % and 40 wt % of the thermal-conducting core.

6. The textile graphene component thermal fiber, as claimed in claim 1, further comprising:

the second quantity of graphene and the quantity of thermally conductive substances being mixed at a ratio of 5:1.

7. The textile graphene component thermal fiber, as claimed in claim 1, further comprising:

the quantity of pigment being approximately 0.5 wt % of the polymeric sheath.

* * * * *